United States Patent [19]

Ito et al.

[11] Patent Number: 5,034,677

[45] Date of Patent: Jul. 23, 1991

[54] BIAS VOLTAGE SUPPLYING CIRCUIT

[75] Inventors: Hidenobu Ito, Nakashima; Fumihiko Sato, Ama, both of Japan

[73] Assignees: Fujitsu Limited, Kawasaki; Fujitsu VLSI Limited, Kasugai, both of Japan

[21] Appl. No.: 572,134

[22] Filed: Aug. 22, 1990

[30] Foreign Application Priority Data

Aug. 22, 1989 [JP] Japan ..... 1-215846

[51] Int. Cl.[5] ..... G05F 3/22

[52] U.S. Cl. ..... 323/313; 323/267; 323/315; 323/901; 307/296.3

[58] Field of Search ..... 323/313, 314, 315, 316, 323/267, 901; 307/296.1, 296.3, 296.6

[56] References Cited

U.S. PATENT DOCUMENTS

| | | | |
|---|---|---|---|
| 3,911,353 | 10/1975 | van de Plassche | 323/315 |
| 4,078,199 | 3/1978 | Chapron et al. | 323/315 |
| 4,683,414 | 7/1987 | Moore | 323/315 |

*Primary Examiner*—Peter S. Wong
*Attorney, Agent, or Firm*—Staas & Halsey

[57] ABSTRACT

A bias voltage supplying circuit for supplying a bias voltage includes first and second PNP type transistors having emitters coupled to a first power source terminal and bases connected to each other, where the first PNP type transistor has a collector coupled to the base thereof, first and second NPN type transistors having collectors respectively connected to collectors of the first and second PNP type transistors, emitters coupled to a second power source terminal and bases connected to each other, where the second NPN type transistor has the collector connected to the base thereof, and a diode part coupled between the emitter of the second PNP type transistor and the base of the second NPN type transistor. The diode part has an anode end coupled to the emitter of the second PNP type transistor and a cathode end coupled to the base of the second NPN type transistor, and the diode part has a forward voltage drop $V_D$ which is less than a voltage $V_S$ across the first and second power source terminals. The voltage $V_S$ is less than a sum of the forward voltage drop $V_D$ and a base-emitter voltage $V_{BE}$ of the second NPN type transistor.

18 Claims, 5 Drawing Sheets

BIAS VOLTAGE SUPPLYING CIRCUIT

BACKGROUND OF THE INVENTION

The present invention generally relates to bias voltage supplying circuits, and more particularly to a bias voltage supplying circuit which supplies a bias voltage for making an internal circuit of a semiconductor integrated circuit active.

Recently, various portable electronic equipments using storage cells have been developed. In such an electronic equipment, it is highly desirable that the power consumption is small so that the electronic equipment can be used for a long time with the limited power supply. On the other hand, in a semiconductor integrated circuit used in such an electronic equipment, a bias voltage supplying circuit is provided to supply a bias voltage to an internal circuit of the semiconductor integrated circuit. This bias voltage supplying circuit is activated by an independent activation circuit. In order to minimize the power consumption, it is necessary to suppress the power consumption of the activation circuit to the limit after the bias voltage supplying circuit is activated.

A conventional bias voltage supplying circuit which is provided with an independent activation circuit will now be described in conjunction with FIG. 1. FIG. 1 shows a bias voltage supplying circuit 1 and an internal circuit 2 which receives a bias voltage from the bias voltage supplying circuit 1. In1 through In4 denote input terminals for receiving input signals, and Ou1 denotes an output terminal. The internal circuit 2 is not directly related to the problems of the bias voltage supplying circuit 1, and a description of the circuit structure and operation with regard to the internal circuit 2 will be omitted.

A power source voltage Vcc from a battery power source, for example, is applied to the bias voltage supplying circuit 1. This power source voltage Vcc is applied to bases of transistors Tr1 and Tr2 via a resistor R1 and a diode D1. Hence, the transistors Tr1 and Tr2 turn ON, thereby turning ON transistors Tr3 and Tr4. The base potential of the transistors Tr3 and Tr4 is supplied to an output terminal 3 via transistors Tr7 and Tr8, and the voltage from the output terminal 3 is supplied to the internal circuit 2 as a bias voltage. Accordingly, the resistor R1 and the diode D1 form an activation circuit 4 which activates the bias voltage supplying circuit 1.

On the other hand, when the transistors Tr3 and Tr4 turn ON, the base potential of the transistors Tr3 and Tr4 is also applied to a base of a transistor Tr5. As a result, the transistor Tr5 turns ON, thereby turning ON a transistor Tr6. In this state, the anode potential of the diode D1 becomes lower than its cathode potential and a forward current of the diode D1 is cut off. Hence, the transistors Tr5, Tr6 and Tr9 form a stop circuit 5 for stopping the operation of the activation circuit 4. After the bias voltage supplying circuit 1 is activated by the activation circuit 4, the stop circuit 5 stops the operation of the activation circuit 5 so as to remove the undesirable effects of the activation circuit 4 on the bias voltage supplying circuit 1 and to prevent unnecessary power consumption caused by an unwanted current flowing through the activation circuit 4.

However, in the bias voltage supplying circuit 1 show in FIG. 1 a collector current continues to flow through the transistors Tr5 and Tr6 of the stop circuit 5 even after the current flowing through the diode D1 via the resistor R1 is cut off by the operation of the stop circuit 5. For this reason, a power consumption occurs at a part which is not directly related to the supplying of the bias voltage, and there is a problem in that the measures taken to reduce the power consumption of the bias voltage supplying circuit 1 is still insufficient. Therefore, there is a demand for an improved bias voltage supplying circuit which has an even smaller power consumption.

SUMMARY OF THE INVENTION

Accordingly, it is a general object of the present invention to provide a novel and useful bias voltage supplying circuit in which the problems described above are eliminated.

Another and more specific object of the present invention is to provide a bias voltage supplying circuit for supplying a bias voltage comprising first and second PNP type transistors having emitters coupled to a first power source terminal and bases connected to each other, where the first PNP type transistor has an emitter coupled to the base thereof, first and second NPN type transistors having collectors respectively connected to collectors of the first and second PNP type transistors, emitters coupled to a second power source terminal and bases connected to each other, where the second NPN type transistor has the collector connected to the base thereof, and diode means coupled between the collector of the second PNP type transistor and the base of the second NPN type transistor. The diode means has an anode end coupled to the emitter of the second PNP type transistor and a cathode end coupled to the base of the second NPN type transistor, and the diode means has a forward voltage drop $V_D$ which is less than a voltage $V_S$ across the first and second power source terminals. The voltage $V_S$ is less than a sum of the forward voltage drop $V_D$ and a base-emitter voltage $V_{BE}$ of the second NPN type transistor. According to the bias voltage supplying circuit of the present invention, it is possible to considerably reduce the power consumption when compared to the conventional bias voltage supplying circuit, without the need for an independent stop circuit exclusively for stopping the activation circuit.

Still another object of the present invention is to provide a bias voltage supplying circuit for supplying a bias voltage comprising first and second PNP type transistors having emitters coupled to a first power source terminal and bases connected to each other, where the first PNP type transistor has a collector coupled to the base thereof, first and second NPN type transistors having collectors respectively connected to collectors of the first and second PNP type transistors, emitters coupled to a second power source terminal and bases connected to each other, where the second NPN type transistor has the collector connected to the base thereof, and Zener diode means coupled between the emitter of the second PNP type transistor and the base of the second NPN type transistor. The Zener diode means has a cathode end coupled to the emitter of the second PNP type transistor and an anode end coupled to the base of the second NPN type transistor, and the Zener diode means has a breakdown voltage $V_Z$ which is less than a voltage $V_S$ across the first and second power source terminals. The voltage $V_S$ is less than a sum of the breakdown voltage $V_Z$ and a base-emitter voltage $V_{BE}$ of the second NPN type transistor. According to the bias voltage supplying circuit of the present invention, it is possible to considerably reduce the power consumption when compared to the conventional bias voltage supplying circuit, without the need for an independent stop circuit exclusively for stopping the activation circuit.

Other objects and further features of the present invention will be apparent from the following detailed description when read in conjunction with the accompanying drawings.

DESCRIPTION OF THE PREFERRED EMBODIMENTS

Figure 2:
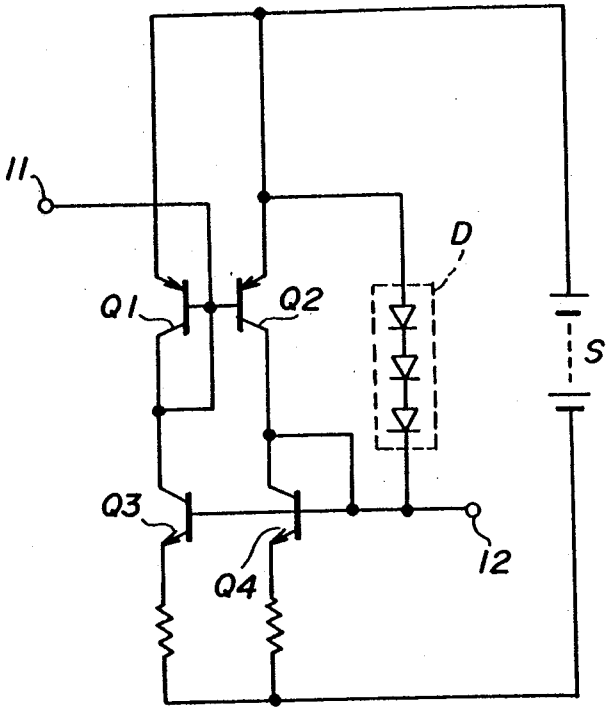
FIG. 2 is a circuit diagram for explaining an operating principle of a bias voltage supplying circuit according to the present invention.

First, a description will be given of an operating principle of a bias voltage supplying circuit according to the present invention, by referring to FIG. 2. In FIG. 2, bases of PNP type transistors Q1 and Q2 are connected, and the base of the transistor Q1 is also connected to a collector of the transistor Q1. On the other hand, bases of NPN type transistors Q3 and Q4 are connected, and a collector of the transistor Q3 is connected to the collector of the transistor Q1 while a collector of the transistor Q4 is connected to a collector of the transistor Q2. In addition, the base and the collector of the transistor Q4 are connected.

Emitters of the transistors Q1 and Q2 are coupled to a power source S. A diode D is connected between the emitter of the transistor Q2 and the bases of the transistors Q3 and Q4. A forward voltage drop $V_D$ across the diode D after the bias voltage supplying circuit is activated is set smaller than a voltage required to operate the diode D. Hence, $V_D<V_S$ where $V_S$ denotes a power source voltage $V_S$ supplied by the power source S, and $V_S<V_{BE}+V_D$, where $V_{BE}$ denotes a base-emitter voltage of the transistor Q4.

When the power source S is connected, the power source volta $V_S$ is applied to the bases of the transistors Q3 and Q4 via the diode D and the transistors Q3 and Q4 turn ON. When the transistors Q3 and Q4 turn ON, the transistors Q1 and Q2 turn ON and the forward current flowing through the diode D is automatically cut off. The transistors Q3 and Q4 are maintained ON by the collector currents of the transistors Q1 and Q2. As a result, it is possible to reduce the power consumption after the bias voltage supplying circuit is activated.

A bias voltage which is supplied to an internal circuit (not shown) of a semiconductor integrated circuit is obtained from a terminal 11 or 12.

Figure 3:
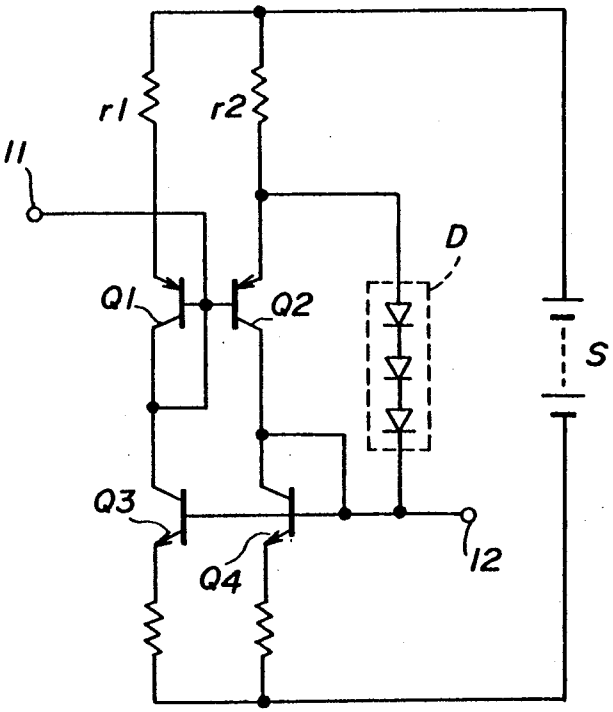
FIG. 3 a circuit diagram showing a first embodiment of the bias voltage supplying circuit according to the present invention.

Next, a description will be given of a first embodiment of the bias voltage supplying circuit according to the present invention, by referring to FIG. 3. In FIG. 3, those parts which are the same as those corresponding parts in FIG. 2 are designated by the same reference numerals, and a description thereof will be omitted.

In this embodiment, resistors r1 and r2 are connected as shown. Depending on the fluctuation of the power source S, the bias voltage required by the internal circuit (not shown) and the like, it is necessary to provide the resistors so as to guarantee the conditions $V_D<V_S$ and $V_S<V_{BE}+V_D$ described above. According to this embodiment, it is possible to provide a fluctuation margin for the power source voltage $V_S$ and fine adjustments can be made of the circuit constants with more flexibility when compared to the bias voltage supplying circuit shown in FIG. 2.

Figure 4:
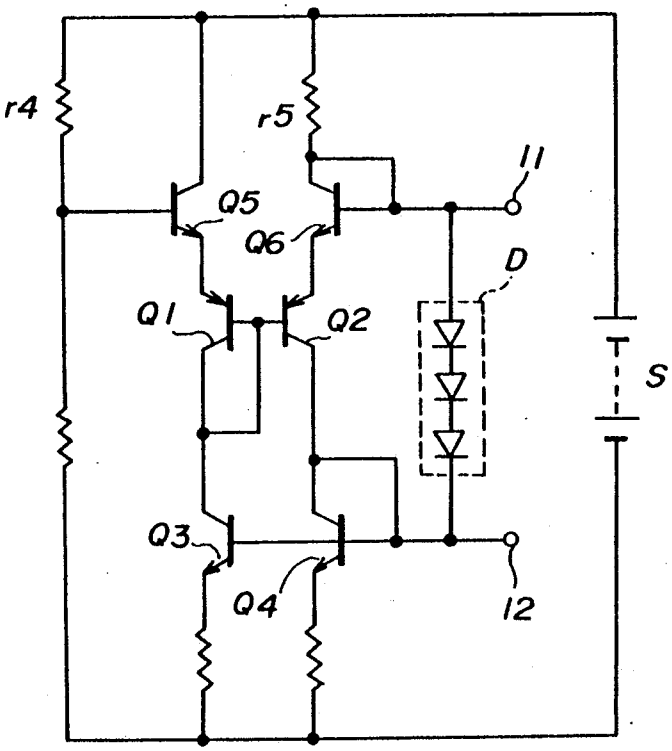
FIG. 4 is a circuit diagram showing a second embodiment of the bias voltage supplying circuit according to the present invention.

Next, a description will be given of a second embodiment of the bias voltage supplying circuit according to the present invention, by referring to FIG. 4. In FIG. 4, those parts which are the same as those corresponding parts in FIG. 2 are designated by the same reference numerals, and a description thereof will be omitted.

In this embodiment, NPN type transistors Q5 and Q6 and resistors r4 and r5 are connected as shown. Emitters of the transistors Q5 and Q6 are respectively connected to the emitters of the transistors Q1 and Q2. A collector of the transistor Q5 is connected to the power source S and a base of the transistor Q5 is coupled to the power source S via the resistor r4. A collector and a base of the transistor Q6 are short-circuited and coupled to the power source S via a resistor r5. The forward voltage drop $V_D$ of the diode D is greater than a voltage drop $V_Q$ of the transistor Q6.

When the transistors Q1 and Q2 turn ON, the transistors Q5 and Q6 also turn ON and the forward current flowing through the diode D is automatically cut off. On the other hand, once the transistors Q3 and Q4 turn ON, the transistors Q3 and Q4 are maintained ON by the collector currents of the transistors Q5 and Q6 and the transistors Q1 and Q2. According to this embodiment, it is also possible to provide a fluctuation margin for the power source voltage $V_S$ and fine adjustments can be made of the circuit constants with more flexibility when compared to the bias voltage supplying circuit shown in FIG. 2.

Figure 5:
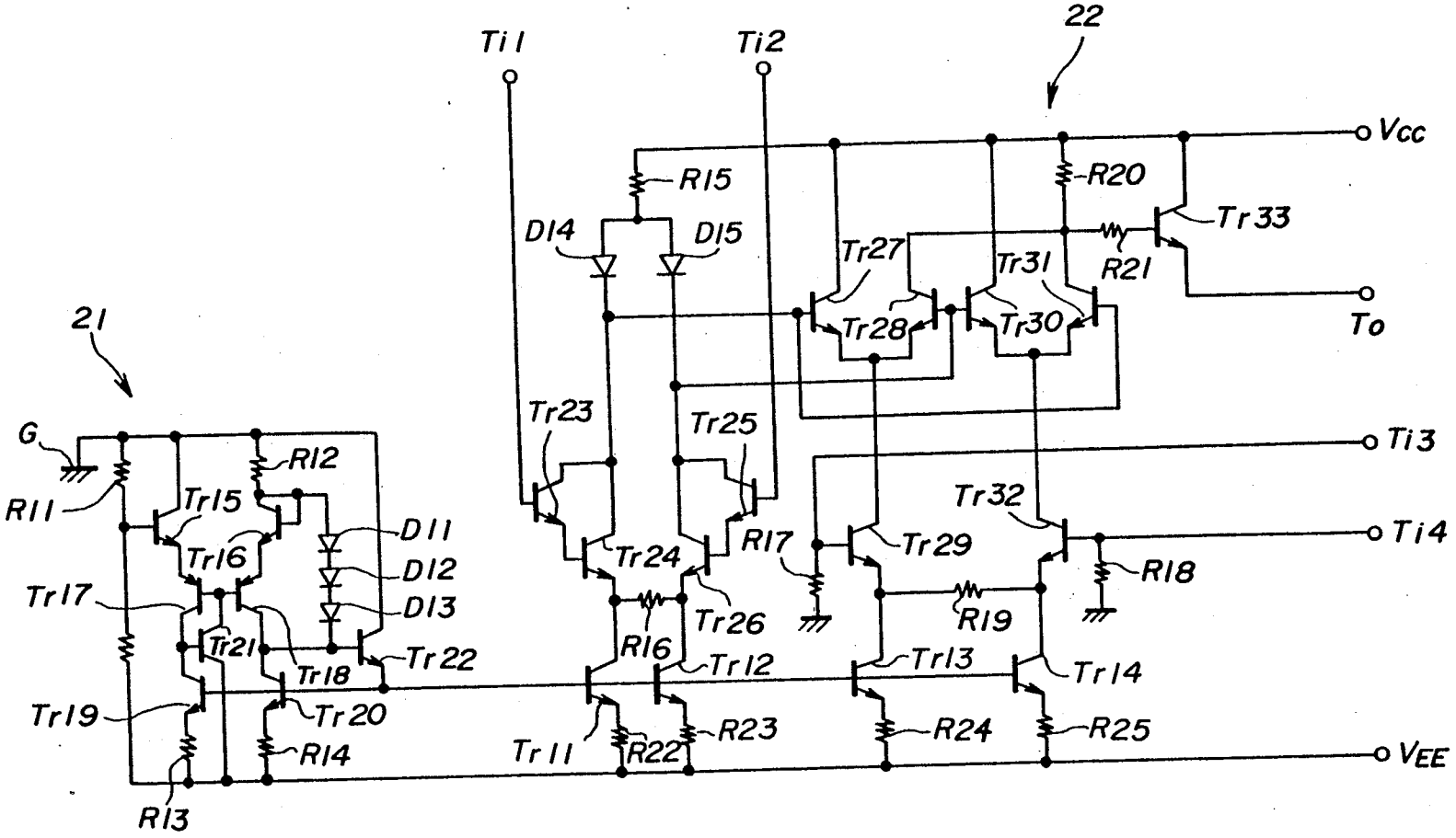
FIG. 5 is a circuit diagram showing a third embodiment of the bias, voltage supplying circuit according to the present invention together with an internal circuit.

Next, a description will be given of a third embodiment of the bias voltage supplying circuit according to the present invention, by referring to FIG. 5 which shows a bias voltage supplying circuit 21 together with an internal circuit 22 which receives the bias voltage.

The bias voltage supplying circuit 21 supplies a bias voltage to transistors Tr11, Tr12, Tr13 and Tr14 which are used as a current source of the internal circuit 22. The bias voltage supplying circuit 21 operates when supplied with a power source voltage $V_{EE}$. Transistors Tr15 and Tr16 of the bias voltage supplying circuit 21 are paired transistors having the same characteristics, and a collector of the transistor Tr15 is connected to ground G while a base of the transistor Tr15 is coupled to the ground G via a resistor R11. A collector of the transistor Tr16 is coupled to the ground G via a resistor R12 while a base of the transistor Tr16 is connected to a collector of the same transistor Tr16.

Transistors Tr17 and Tr18 of the bias voltage supplying circuit 21 are also paired transistors. Emitters of the transistors Tr17 and Tr18 are respectively connected to emitters of the transistors Tr15 and Tr16 while bases of the transistors Tr17 and Tr18 are connected to each other so as to form a current mirror circuit.

Transistors Tr19 and Tr20 of the bias voltage supplying circuit 21 are also paired transistors. Collectors of the transistors Tr19 and Tr20 are respectively connected to collectors of the transistors Tr17 and Tr18. The power source voltage $V_{EE}$ is supplied to emitters of the transistors Tr19 and Tr20 via respective resistors R13 and R14. In addition, bases of the transistors Tr19 and Tr20 are connected to each other. The bases of the transistors Tr19 and Tr20 are also connected to bases of the transistors Tr11 through Tr14 of the internal circuit 22 so as to supply the bias voltage to the internal circuit 22.

Bases of the transistors Tr17 and Tr18 are connected to an emitter of a transistor Tr21. A base of the transistor Tr21 is connected to the collectors of the transistors Tr17 and Tr19. A collector of the transistor Tr21 is connected to the power source $V_{EE}$. The transistor Tr21 flows the base currents of the transistors Tr17 and Tr18 to the power source $V_{EE}$ so as to reduce the undesirable effects of the base currents on the operation of the transistors Tr19 and Tr20.

A base of a transistor Tr22 is connected to the collector of the transistor Tr18, and a collector of the transistor Tr22 is connected to the ground G. An emitter of the transistor Tr22 is connected to the bases of the transistors Tr19 and Tr20. In addition, three diodes D11, D12 and D13 are connected in series between the base of the transistor Tr22 and the collector of the transistor Tr16. The diodes D11, D12 and D13 form an activation circuit for making the bias voltage supplying circuit 21 active, and the diodes D11, D12 and D13 are connected in such a direction that the cathode of the diode D13 connects to the base of the transistor Tr22. The series connected diodes D11, D12 and D13 are provided in parallel to the series connected transistors Tr16 and Tr18. A forward voltage group across the series connected diodes D11, D12 and D13 is set greater than a voltage drop across the transistors Tr16 and Tr18 when these transistors Tr16 and Tr18 are ON.

Next, a description will be given of the circuit structure of the internal circuit 22. An input terminal Ti1 is connected to a base of the transistor Tr23 . A collector of the transistor Tr23 is connected to a collector of the transistor Tr24, and an emitter of the transistor Tr23 is connected to a base of a transistor Tr24. A power source voltage $V_{CC}$ is applied to the collectors of the transistors Tr23 and Tr24 via a resistor R15 and a diode D14. An emitter of the transistor Tr24 is connected to a collector of the transistor Tr11. Accordingly, when the transistor Tr11 is ON and a high-level signal is applied to the input terminal Ti1, the transistors Tr23 and Tr24 turn ON.

An input terminal Ti2 is connected to a base of a transistor Tr25. A collector of the transistor Tr25 is connected to a collector of a transistor Tr26, and an emitter of the transistor Tr25 is connected to a base of the transistor Tr26. The power source voltage $V_{CC}$ is supplied to the collectors of the transistors Tr25 and Tr26 via the resistor R15 and a diode D15. An emitter of the transistor Tr26 is connected to a collector of the transistor Tr12. Accordingly, when the transistor Tr12 is ON and a high-level signal is applied to the input terminal Ti2, the transistors Tr25 and Tr26 turn ON. The emitters of the transistors Tr24 and Tr26 are coupled via a resistor R16 and these emitters are constantly maintained to the same potential.

The collectors of the transistors Tr23 and Tr24 are respectively connected to bases of transistors Tr27 and Tr31. The collectors of the transistors Tr25 and Tr26 are respectively connected to bases of transistors Tr28 and Tr30. The transistors Tr27 and Tr28 and the transistors Tr30 and Tr31 respectively form a differential amplifier. Emitters of the transistors Tr27 and Tr28 are connected to a collector of a transistor Tr29, and emitters of the transistors Tr30 and Tr31 are connected to a collector of a transistor Tr32.

Collectors of the transistors Tr27 and Tr30 are connected to the power source $V_{CC}$, and collectors of the transistors Tr28 and Tr31 are coupled to the power source $V_{CC}$ via a resistor R20. In addition, collectors of the transistors Tr28 and Tr31 are coupled to a base of a transistor Tr33, via a resistor R21. The collector of the transistor Tr33 is connected to the power source $V_{CC}$ and an emitter of the transistor Tr33 is connected to an output terminal T0.

A base of the transistor Tr29 is connected to an input terminal Ti3 on one hand, and is coupled to the ground G via a resistor R17 on the other. An emitter of the transistor Tr29 is connected to a collector of the transistor Tr13. In addition, a base of a transistor Tr32 is connected to an input terminal Ti4 on one hand, and is coupled to the ground G via a resistor R18 on the other. The emitter of the transistor Tr32 is connected to a collector of the transistor Tr14.

When a high-level signal is applied to the input terminal Ti3, the transistor Tr29 turns ON. If the transistor Tr13 is ON in this state, the transistors Tr27 and Tr28 become operable. When a high-level signal is applied to the input terminal Ti4, the transistor Tr32 turns ON. If the transistor Tr14 is ON in this state, the transistors Tr30 and Tr31 become operable. The emitters of the transistors Tr29 and Tr32 are coupled via a resistor R19 and are constantly maintained to the same potential.

In the internal circuit 22 having the circuit structure described above, when high-level signals are applied to the input terminals Ti1 and Ti3 and low-level signals are applied to the input terminals Ti2 and Ti4 in a state where the transistors Tr11 through Tr14 are ON, the transistor Tr27 turns OFF, the transistor Tr28 turns ON and the transistors Tr30 and Tr31 turn OFF. Accordingly, the transistor Tr33 turns OFF. On the other hand, when a low-level signal is applied to the input terminal Ti3 and a high-level signal is applied to the input terminal Ti4 in this state, the transistors Tr27 and Tr28 turn OFF, the transistor Tr30 turns ON and the transistor Tr31 turns OFF. Then, the transistor Tr33 turns ON and the collector current is output via the output terminal T0.

When the power source voltage $V_{EE}$ is supplied to the bias voltage supplying circuit 21 having the circuit structure described above, the base current is supplied to the transistor Tr22 via the diodes D11 through D13. Hence, the transistor Tr22 turns ON, and the transistors Tr19 and Tr20 are turned ON by the emitter current of the transistor Tr22. At the same time, the base current is supplied to the transistors Tr11 through Tr14 of the internal circuit 22. When the transistors Tr19 and Tr20 turn ON, the transistors Tr15 through Tr18 and Tr21 turn ON. As a result, the forward voltage drop of the diodes D11 through D13 becomes greater than the voltage drop of the transistors Tr16 and Tr18, and the forward current flowing through the diodes D11 through D13 is cut off. Hence, the base current is supplied to the transistor Tr22 from the collector of the transistor Tr18. The transistor Tr22 is maintained ON, and the bias voltage is supplied to the transistors Tr11 through Tr14 of the internal circuit 22. The bias voltage supplying circuit 21 is made active in the above described manner.

When the power source voltage $V_{EE}$ is supplied to the bias voltage supplying circuit 21 when activating the same, the forward current flows through the diodes D11 through D13 to activate the bias voltage supplying circuit 21. After the bias voltage supplying circuit 21 is made active by the activation circuit which is formed by the diodes D11 through D13, the forward current flowing through the diodes D11 through D13 is automatically cut off by the operation of the bias voltage supplying circuit 21. Therefore, it is unnecessary to provide an independent stop circuit for stopping the operation of the activation circuit in order to cut off the forward current which flows through the diodes D11 through D13, and the power consumption of the bias voltage supplying circuit 21 can be reduced considerably compared to the conventional bias voltage supplying circuit.

Figure 6:
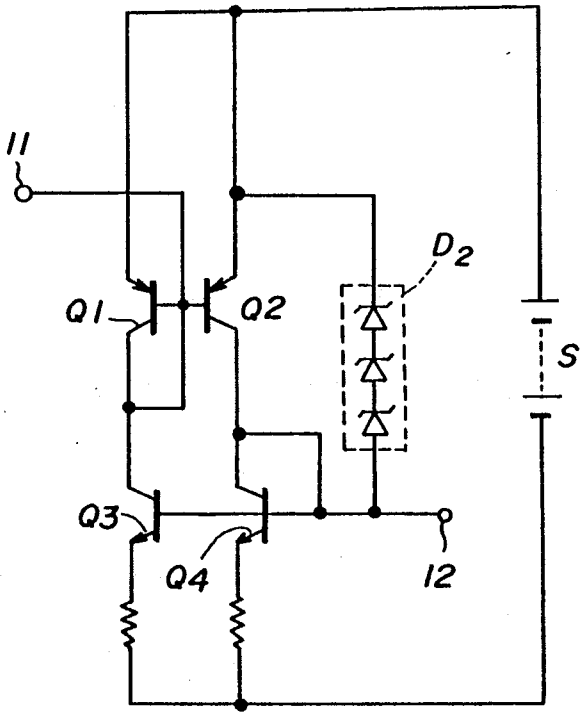
FIG. 6 is a circuit diagram showing a fourth embodiment of the bias voltage supplying circuit according to the present invention.

Next, a description will be given of a fourth embodiment of the bias voltage supplying circuit according to the present invention, by referring to FIG. 6. In FIG. 6, those parts which are essentially the same as those corresponding parts in FIG. 2 are designated by the same reference numerals, and a description thereof will be omitted.

In this embodiment, a Zener diode $D_Z$ is provided in place of the diode D shown in FIG. 2 and is connected in a direction opposite to that of the diode D. In this case, a breakdown voltage $V_Z$ of the Zener diode $D_Z$ is set so that $V_Z < V_S$ where $V_S$ denotes the power source voltage $V_S$ supplied by the power source S, and $V_S < V_{BE} + V_Z$, where $V_{BE}$ denotes a base-emitter voltage of the transistor Q4. Hence, when making the bias voltage supplying circuit active, the Zener diode $D_Z$ breaks down and supplies the power source voltage $V_S$ to the bases of the transistors Q3 and Q4 to turn these transistors Q3 and Q4 ON. But when the transistors Q3 and Q4 turn ON and the bias voltage supplying circuit is made active, the voltage at the Zener diode $D_Z$ decreases and no breakdown of the Zener diode $D_Z$ occurs. In this case, the power source voltage $V_S$ is no longer supplied to the bases of the transistors Q3 and Q4 from the Zener diode $D_Z$. As a result, the effect of reducing the power consumption of the bias voltage supplying circuit is the same as the bias voltage supplying circuit shown in FIG. 2.

Of course, in FIG. 6, the resistors shown in FIG. 3 may be provided as in the case of the first embodiment, and the transistors Q5 and Q6 and the resistors r4 and r5 shown in FIG. 4 may be provided as in the case of the second embodiment. Further, transistors similar to the transistors Tr21 and Tr22 shown in FIG. 5 may be provided as in the case of the third embodiment.

Figure 7:
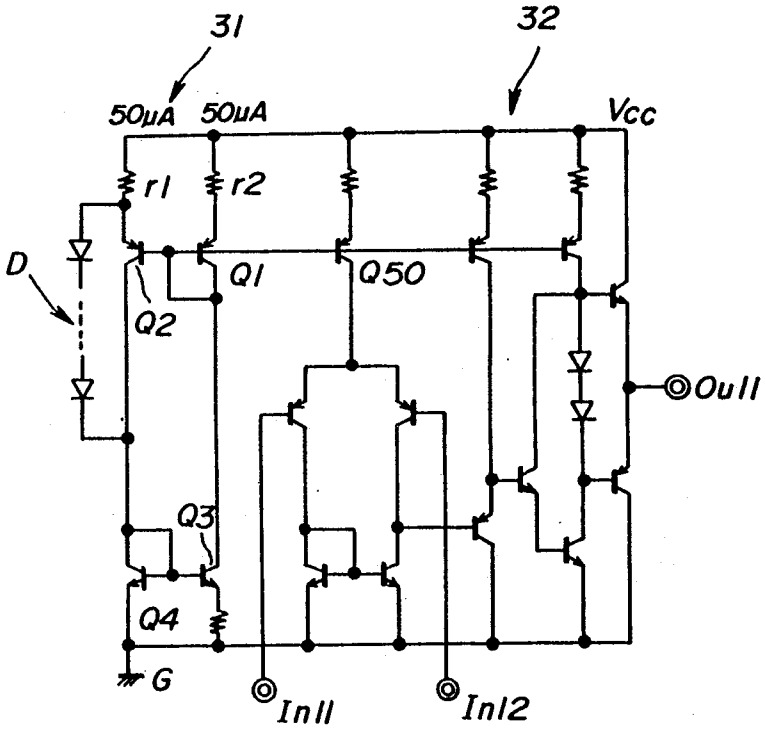
FIG. 7 is a circuit diagram showing a fifth embodiment of the bias voltage supplying circuit according to the present invention together with an internal circuit.

Next, a description will be given of a fifth embodiment of the bias voltage supplying circuit according to the present invention, by referring to FIG. 7 which shows a bias voltage supplying circuit 31 together with an internal circuit 32. In FIG. 7, those parts which are essentially the same as those corresponding parts in FIG. 3 are designated by the same reference numerals, and a description thereof will be omitted.

The internal circuit 32 has input terminals In11 and In12 for receiving differential input signals and an output terminal Ou11. In this embodiment, the bias voltage supplying circuit 31 supplies a bias voltage from the bases of the transistors Q1 and Q2 to a base of a transistor Q50 of the internal circuit 32. The details of the structure and operation of the internal circuit 32 will be omitted for the sake of convenience.

Figure 1:
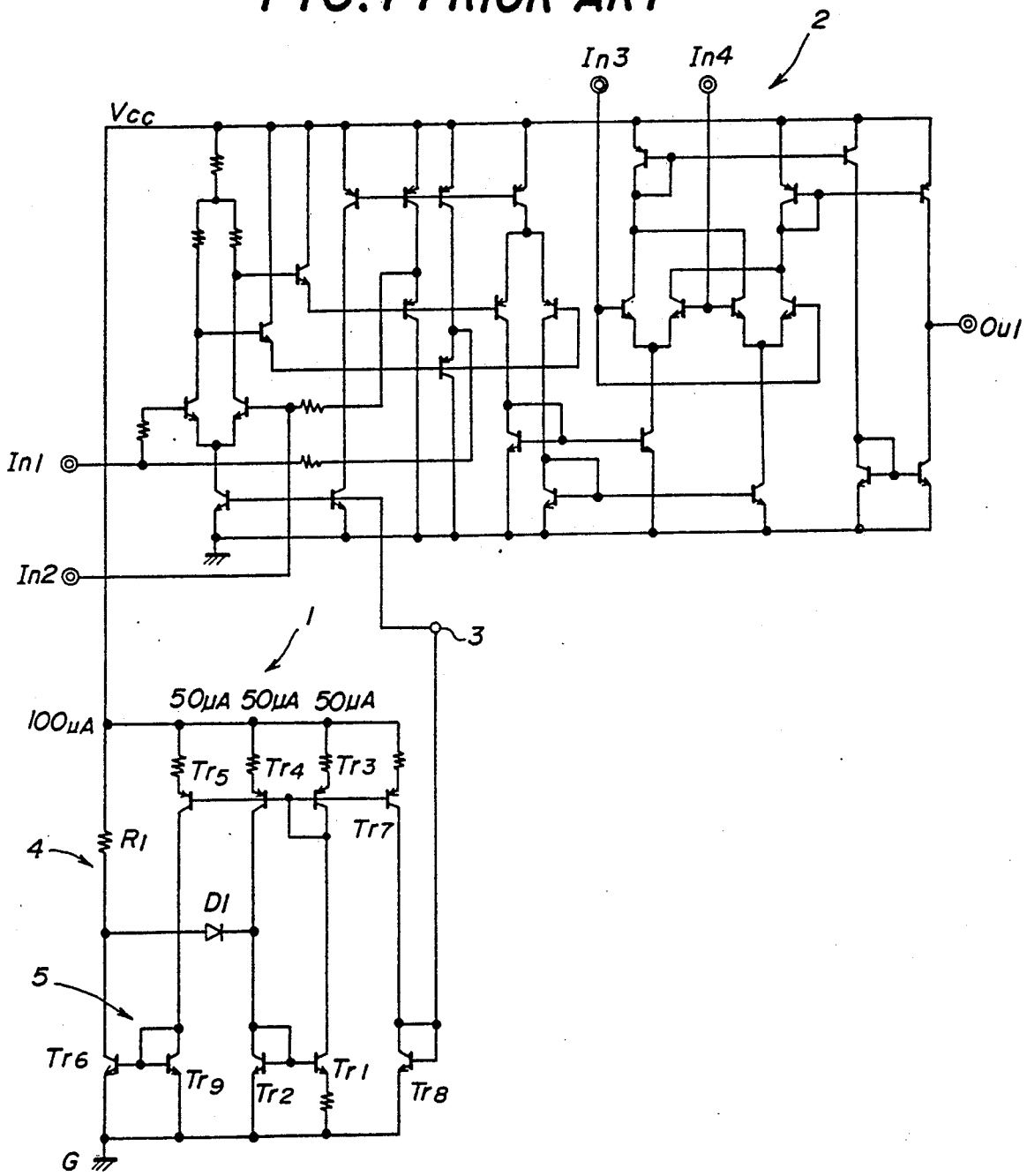
FIG. 1 PRIOR ART
FIG. 1 a circuit diagram for explaining an operation of a bias voltage supplying circuit.

In FIG. 7, the values of currents actually flowing through the resistors r1 and r2 are shown under a predetermined condition. On the other hand, the values of current actually flowing at various parts of the conventional bias voltage supplying circuit 1 shown in FIG. 1 are also shown under a condition similar to the predetermined condition. It is readily apparent from a comparison of FIGS. 1 and 7 that the power consumption of the bias voltage supplying circuit 32 is considerably reduced when compared to that of the conventional bias voltage supplying circuit 1 shown in FIG. 1.

Therefore, according to the present invention, the current used to initially make the bias voltage supplying circuit active is automatically cut off after the activation, without the need of an independent stop circuit which is used exclusively for stopping the supply of current. As a result, the power consumption of the bias voltage supplying circuit is considerably reduced compared to that of the conventional bias voltage supplying circuit. In addition, in order to reduce the power consumption, the conventional bias voltage supplying circuit may require a resistor having a large resistance. But when a resistor having a large resistance is used in an integrated circuit, a large chip area is occupied by the resistor because the resistor having the large resistance is bulky. On the other hand, the present invention reduces the power consumption without the need of a resistor having a large resistor, and is suited for use in the integrated circuit because the chip area utilization will not be affected by the measures taken to reduce the power consumption.

Further, the present invention is not limited to these embodiments, but various variations and modifications may be made without departing from the scope of the present invention.

What is claimed is:

1. A bias voltage supplying circuit for supplying a bias voltage comprising:

first and second PNP type transistors having emitters coupled to a first power source terminal and bases connected to each other, said first PNP type transistor having a collector coupled to the base thereof;

first and second NPN type transistors having collectors respectively connected to collectors of said first and second PNP type transistors, emitters coupled to a second power source terminal and bases connected to each other, said second NPN type transistor having the collector connected to the base thereof; and diode means coupled between the emitter of said second PNP type transistor and the base of said second NPN type transistor, said diode means having an anode end coupled to the emitter of said second PNP type transistor and a cathode end coupled to the base of said second NPN type transistor, said diode means having a forward voltage drop $V_D$ which is less than a voltage $V_S$ across said first and second power source terminals, said voltage $V_S$ being less than a sum of said forward voltage drop $V_D$ and a base-emitter voltage $V_{BE}$ of said second NPN type transistor.

2. The bias voltage supplying circuit as claimed in claim 1, wherein said first and second NPN type transistors are initially turned ON by the voltage $V_S$ due to a current flowing through said diode means and thereafter maintained ON after said first and second PNP type transistors turn ON responsive to the ON state of said first and second NPN type transistors, said current flowing through said diode means being cut off after said first and second PNP type transistors turn ON.

3. The bias voltage supplying circuit as claimed in claim 1, wherein said bias voltage is output via the emitter of said second PNP type transistor.

4. The bias voltage supplying circuit as claimed in claim 1, wherein said bias voltage is output via the bases of said first and second NPN type transistors.

5. The bias voltage supplying circuit as claimed in claim 1, wherein said bias voltage is output via the bases of said first and second PNP type transistors.

6. The bias voltage supplying circuit as claimed in claim 1, which further comprises a first resistor coupled between the emitter of said first PNP type transistor and said first power source terminal, and a second resistor coupled between the emitter of said second PNP type transistor and said first power source terminal.

7. The bias voltage supplying circuit as claimed in claim 1, which further comprises third and fourth NPN type transistors and first and second resistors, said third NPN type transistor having a collector connected to said first power source terminal, a base coupled to said first power source terminal via said first resistor and an emitter connected to the emitter of said first PNP type transistor, said fourth NPN type transistor having a collector coupled to said first power source terminal via said second resistor, a base connected to the collector thereof and an emitter connected to the emitter of said second PNP type transistor, said anode end of said diode means being connected to the base of said fourth NPN type transistor.

8. The bias voltage supplying circuit as claimed in claim 1, which further comprises a third PNP type transistor having an emitter connected to the bases of said first and second PNP type transistors, a base connected to the collector of said first PNP type transistor and a collector coupled to said second power source terminal.

9. The bias voltage supplying circuit as claimed in claim 1, which further comprises a third NPN type transistor having a collector connected to said first power source terminal, a base connected to the collector of said second NPN type transistor and the cathode end of said diode means and an emitter connected to the base of said second NPN type transistor.

10. A bias voltage supplying circuit for supplying a bias voltage comprising:

first and second PNP type transistors having emitters coupled to a first power source terminal and bases connected to each other, said first PNP type transistor having a collector coupled to the base thereof;

first and second NPN type transistors having collectors respectively connected to collectors of said first and second PNP type transistors, emitters coupled to a second power source terminal and bases connected to each other, said second NPN type transistor having the collector connected to the base thereof; and Zener diode means coupled between the emitter of said second PNP type transistor and the base of said second NPN type transistor, said Zener diode means having a cathode end coupled to the emitter of said second PNP type transistor and an anode end coupled to the base of said second NPN type transistor, said Zener diode means having a breakdown voltage $V_Z$ which is less than a voltage $V_S$ across said first and second power source terminals, said voltage $V_S$ being less than a sum of said breakdown voltage $V_Z$ and a base-emitter voltage $V_{BE}$ of said second NPN type transistor.

11. The bias voltage supplying circuit as claimed in claim 10, wherein said first and second NPN type transistors are initially turned ON by the voltage $V_S$ due to a current flowing through said Zener diode means and thereafter maintained ON after said first and second PNP type transistors turn ON responsive to the ON state of said first and second NPN type transistors, said current flowing through said Zener diode means being cut off after said first and second PNP type transistors turn ON.

12. The bias voltage supplying circuit as claimed in claim 10, wherein said bias voltage is output via the emitter of said second PNP type transistor.

13. The bias voltage supplying circuit as claimed in claim 10, wherein said bias voltage is output via the bases of said first and second NPN type transistors.

14. The bias voltage supplying circuit as claimed in claim 10, wherein said bias voltage is output via the bases of said first and second PNP type transistors.

15. The bias voltage supplying circuit as claimed in claim 10, which further comprises a first resistor coupled between the emitter of said first PNP type transistor and said first power source terminal, and a second resistor coupled between the emitter of said second PNP type transistor and said first power source terminal.

16. The bias voltage supplying circuit as claimed in claim 10, which further comprises third and fourth NPN type transistors and first and second resistors, said third NPN type transistor having a collector connected to said first power source terminal, a base coupled to said first power source terminal via said first resistor and an emitter connected to the emitter of said first PNP type transistor, said fourth NPN type transistor having a collector coupled to said first power source terminal via said second resistor, a base connected to the collector thereof and an emitter connected to the emitter of said second PNP type transistor, said cathode end of said Zener diode means being connected to the base of said fourth NPN type transistor.

17. The bias voltage supplying circuit as claimed in claim 10, which further comprises a third PNP type transistor having an emitter connected to the bases of said first and second PNP type transistors, a base connected to the collector of said first PNP type transistor and a collector coupled to said second power source terminal.

18. The bias voltage supplying circuit as claimed in claim 10, which further comprises a third NPN type transistor having a collector connected to said first power source terminal, a base connected to the collector of said second NPN type transistor and the anode end of said Zener diode means and an emitter connected to the base of said second NPN type transistor.

* * * * *